US008057366B2

(12) United States Patent
Schippers et al.

(10) Patent No.: US 8,057,366 B2
(45) Date of Patent: Nov. 15, 2011

(54) BODY-STIMULATING APPARATUS WITH AN OSCILLATING FOOTPLATE

(75) Inventors: Rowdy Arjan Schippers, Neerpelt (BE); Franciscus Leonardes Koene, Neerpelt (BE)

(73) Assignee: Johanna Hendrica Maria Van Den Hoogen, Neerpelt (BE) (NL)

( * ) Notice: Subject to any disclaimer, the term of this patent is extended or adjusted under 35 U.S.C. 154(b) by 0 days.

(21) Appl. No.: 12/688,608

(22) Filed: Jan. 15, 2010

(65) Prior Publication Data

US 2010/0184568 A1 Jul. 22, 2010

Related U.S. Application Data

(62) Division of application No. 11/894,717, filed on Aug. 21, 2007, now abandoned.

(51) Int. Cl.
*A63B 22/06* (2006.01)
*A63B 22/00* (2006.01)

(52) U.S. Cl. ..... 482/92; 482/110

(58) Field of Classification Search ..... 482/51–52, 482/1, 92, 148; 601/35, 65, 90, 105
See application file for complete search history.

(56) References Cited

U.S. PATENT DOCUMENTS

| | | | |
|---|---|---|---|
| 2,566,484 | A | 9/1951 | Coury |
| 4,430,992 | A | 2/1984 | Christ |
| 4,787,630 | A | 11/1988 | Watson et al. |
| 4,858,599 | A | 8/1989 | Halpern et al. |
| 5,273,028 | A | 12/1993 | McLeod et al. |
| 6,620,117 | B1 | 9/2003 | Johnson et al. |
| 6,659,918 | B2 | 12/2003 | Schiessl |
| 7,390,287 | B2 | 6/2008 | Wu |
| 7,402,145 | B1 | 7/2008 | Woggon et al. |

FOREIGN PATENT DOCUMENTS

| | | |
|---|---|---|
| GB | 417 550 | 10/1934 |

*Primary Examiner* — Stephen Crow
(74) *Attorney, Agent, or Firm* — Eric Karich

(57) ABSTRACT

An apparatus for the stimulation of the body has a footplate, which is connected to two oscillation devices and that are present on a supporting plate, which each have a driven shaft. Braces are fastened on the extremities of the shafts, which are eccentric with respect to the shafts. Plates are fastened on the footplate, which are provided with slots in which the braces can be moved. The apparatus also has guiding elements fastened on the supporting plate, which can be moved in vertical guides that are formed by slots present in the plates.

1 Claim, 2 Drawing Sheets

BODY-STIMULATING APPARATUS WITH AN OSCILLATING FOOTPLATE

CROSS-REFERENCE TO RELATED APPLICATIONS

This application for a utility patent is a Divisional of a previously filed utility patent, now abandoned, having the application Ser. No. 11/894,717, filed Aug. 21, 2007.

BACKGROUND OF THE INVENTION

1. Field of the Invention

The invention relates to a body-stimulating apparatus, and more particularly to an apparatus that includes a supporting plate, a footplate above it and two oscillation devices present at a distance from each other on the supporting plate and connected to the footplate for the oscillation of the footplate.

2. Description of Related Art

Such an apparatus is known from WO 03/057321. In this well-known apparatus, the oscillation devices are formed by eccentric mechanisms and the footplate can be tipped with respect to a shaft fastened to the footplate.

SUMMARY OF THE INVENTION

An objective of the invention is to improve the well-known apparatus. For this purpose the apparatus according to the invention is characterized in that the apparatus comprises guiding devices via which the footplate is connected to the supporting plate, which guiding devices guide the footplate mainly in a vertical direction. Guiding devices, which guide an element to be guided at least mainly in a vertical direction, are defined as guiding devices in which an element to be guided (that is connected to the footplate) can only move vertically or in which a small horizontal movement is also possible in addition to the vertical main movement. In the apparatus according to the invention the middle of the footplate is not held in a horizontal direction and the footplate can make small horizontal movements during tipping. This horizontal oscillating movement has a better effect on the user of the apparatus so that the apparatus according to the invention stimulates the body even more.

Preferably the guiding devices comprise at least one at any rate mainly vertical guide fastened on the supporting plate, and at least one guiding element connected to the footplate and working together with the guide.

An embodiment of the apparatus according to the invention is characterized in that the guiding element is connected to an auxiliary element present between the footplate and the supporting plate where the footplate is connected to the auxiliary element via flexible and/or elastic buffer elements. This produces a tipping vibration movement by means of the vertical and horizontal movement. Moreover, this suppresses the noise the footplate causes during tipping (which is caused by the movement of the guiding element in the guide).

Preferably the buffer elements comprise rubber blocks, which are present between and fastened to the footplate and the supporting plate. Moreover, there are preferably at least four rubber blocks present, one near each corner of the footplate.

Another embodiment of the apparatus according to the invention is characterized in that the guiding devices comprise flexible and/or elastic suspension elements, which are fastened by an extremity to the supports present on the bottom of the footplate and are fastened by the other extremity to further supports present on the top of the supporting plate. Preferably the suspension elements are formed by rubber blocks in this embodiment.

For extra support of the footplate, preferably at least one roller is present in the middle of both shafts, which is fastened to the footplate or the supporting plate, and which is in contact with the supporting plate and the footplate respectively. Preferably the apparatus has two rollers present at a distance from each other, which for example are formed by ball bearings that are connected to the footplate and roll over the supporting plate.

The footplate is preferably provided with one or more fastening lugs in order to improve the applications of the apparatus according to the invention, to which a mat, straps or massage belt can be fastened. This also enables a massaging action to be performed with the apparatus according to the invention by means of a massage belt, which is placed around the waist of a user preferably standing next to the footplate, or by means of straps, which a user preferably standing next to the footplate can hold taut with his hands, which is not possible with the well-known apparatus.

To improve the massage effect further, a mat is preferably present on the footplate and is connected to the footplate. This mat can for example be fastened to the above-mentioned fastening lugs.

An embodiment of the apparatus according to the invention is characterized in that the movement that one of the oscillation devices makes is out of phase with and/or has another amplitude than the movement of the other oscillation devices. This causes the footplate not only to vibrate in a vertical direction, but also causes the footplate to make a slight tipping movement. A further embodiment is characterized in that the oscillation devices can oscillate the footplate independently of each other in order to vary the movement of the footplate optimally.

A still further embodiment of the apparatus according to the invention is characterized in that the oscillation devices each comprise a driven shaft, which is connected with bearings on the supporting plate, and a connecting element eccentrically connected to the shaft, in which the footplate is connected to further connecting elements that work together with the connecting elements connected to the shaft. This has the advantage that the connecting element always follows the eccentric movement and cannot, as for example can be the case with a cam and a cam follower, become loose of the cam as a result of the inertia of the footplate. The connecting elements are here preferably twisted with respect to each other. This also causes the footplate to vibrate in a horizontal direction, so that the effect of the apparatus is even better.

Preferably the connecting elements are formed by braces and the further connecting elements are provided with slots in which the braces can be moved. In this construction the friction between the braces and the further connecting elements is small, certainly if the braces are formed by ball bearings that can roll along the walls of the slot.

Again a further embodiment of the apparatus is characterized in that the apparatus comprises two motors, which can each drive one of the shafts independently of each other. This means even more variations can be introduced into the way the footplate can be made to vibrate.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above-described drawing figures illustrate the invention, a body-stimulating apparatus with an oscillating footplate.

Figure 1:
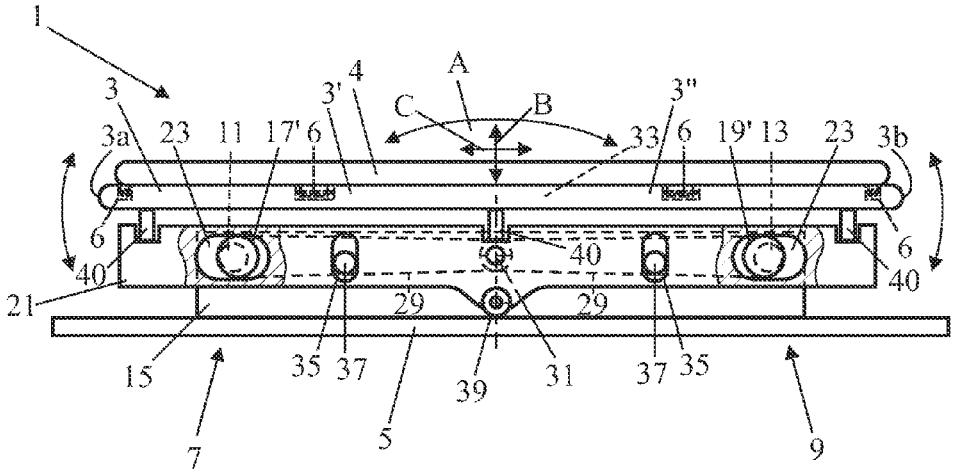
FIG. 1 is a first embodiment of the apparatus according to the invention in side elevation.
Figure 2:
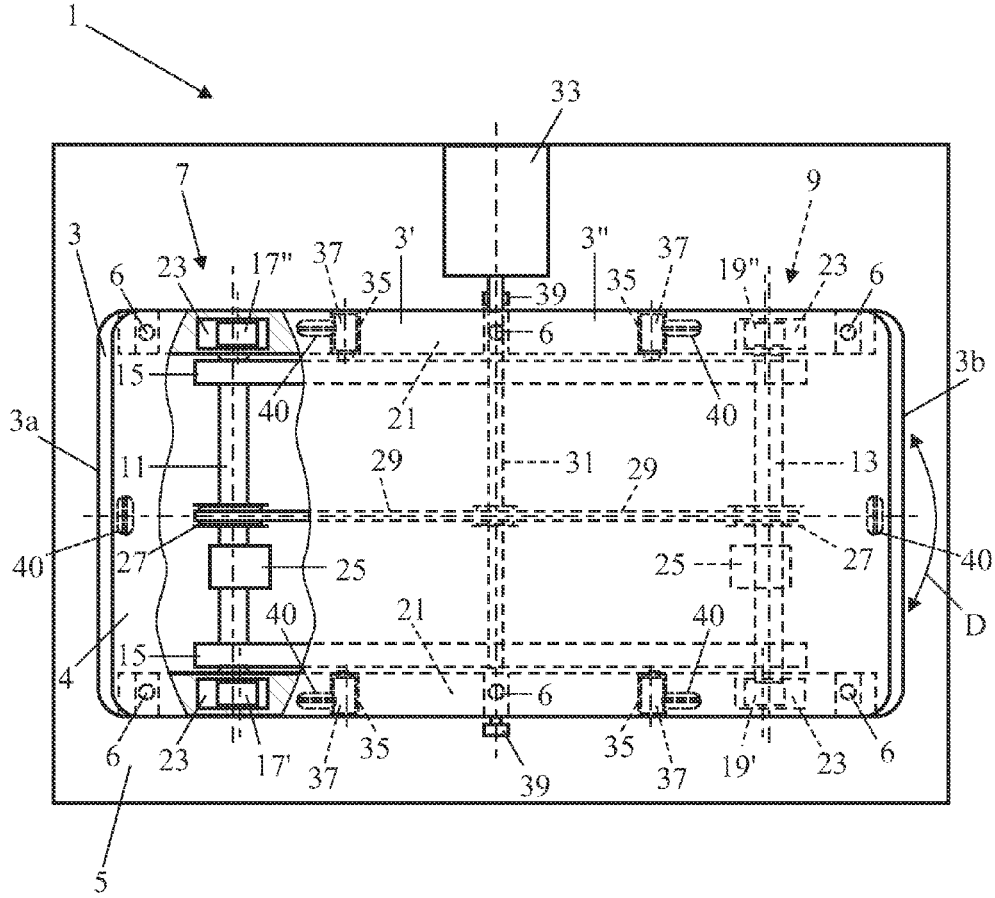
FIG. 2 is a top plan view of the apparatus shown in FIG. 1.

FIGS. 1 and 2 show a first embodiment of the apparatus according to the invention in side elevation and from above respectively. The apparatus 1 has a footplate 3 that is connected to two oscillation devices 7 and 9 present on a supporting plate 5, in which each half 3', 3" of the footplate 3 is connected to one of the oscillation devices. There is a mat 4 present on the footplate whose bottom is fastened by straps to fastening lugs 6 that are present in the footplate 3. These fastening lugs 6 are formed by oval notches at the top of the footplate 3 and a pin present in the notches in a lengthwise direction around which a strap is fastened to the mat present. The oscillation devices 7, 9 each have a driven shaft 11, 13, which is connected by bearings to the plates 15 fastened to the supporting plate 5. Connecting elements in the form of braces 17', 17", 19', 19" are fastened to the extremities of the shafts 11, 13, which are eccentric with respect to the shafts 11, 13. Further connecting elements are fastened to the footplate 3 in the form of plates 21 provided with slots 23 in which the braces 17', 17", 19', 19" can be moved. The braces are formed by shaft stubs, which are fastened eccentrically to the extremities of the shafts 11 and 13 and on which noiseless ball bearings are present, which are provided with a rubber layer in their track. The braces 17' and 19' and 17" and 19" respectively are twisted at 180 with respect to each other.

Because of this construction the footplate 3 also makes a vertical and a horizontal to and fro movement, arrow A and arrow B respectively, of several millimeters during the use of the apparatus as well as a tipping movement, arrow A, in which the extremities 3*a*, 3*b* of the footplate move up and down approximately 1 to 13 mm. Both braces 17' and 17" and 19' and 19" respectively that are present on the shaft can also be twisted with respect to each other. This means that the footplate can also make a tipping movement around the lengthwise shaft, arrow D.

There are counter-weights 25 on shafts 11 and 13 that are present eccentrically with respect to the shafts and which prevent the eccentrically placed braces 17', 17", 19', 19" from causing imbalance. There are also geared belt wheels 27 on both shafts 11 and 13, which are connected via geared belts 29 to a central driving shaft 31. The driving shaft is driven by an electrical motor 33 that is present on the supporting plate.

The apparatus 1 moreover has guiding devices that are formed by guides 35 present on the footplate 3, which are made as vertical slots in the plates 21 and which can be moved along guiding elements 37 fastened on the plates 15, which are ball bearings with a rubber track to allow small movements in a horizontal direction by the footplate with respect to the supporting plate. Moreover, there are ball bearings 39 in the middle of the shafts 11 and 13 that are fastened at the bottom of the footplate 3, which roll over the supporting plate 5 during oscillation to support the footplate better.

The footplate 3 is connected via six flexible and/or elastic buffer elements, formed by rubber blocks 40, to auxiliary elements that are formed by the plates 21. This suppresses the noise caused by the movement of the guiding elements 37 in the guides 35. Four of the rubber blocks are present near the corners of the footplate and the other two are near the middle of each lengthwise edge of the footplate.

Figure 3:
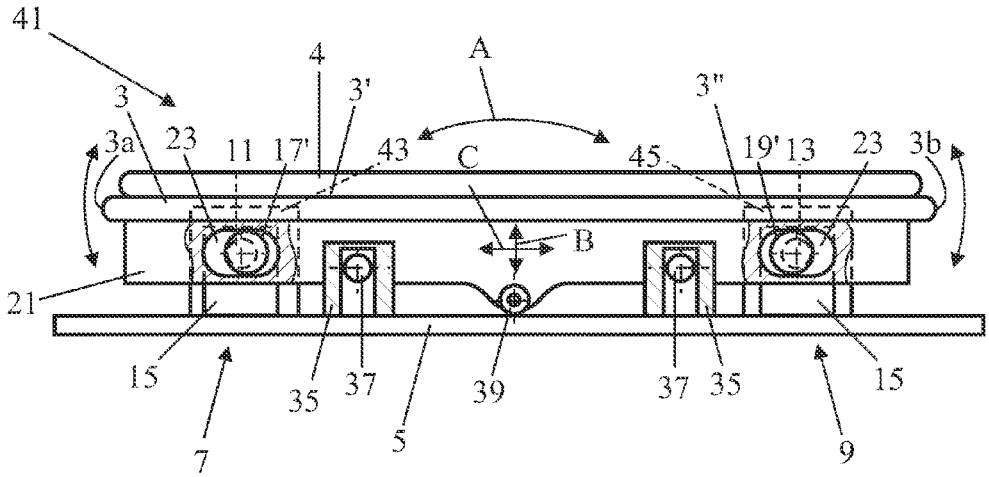
FIG. 3 is a second embodiment of the apparatus according to the invention in side elevation.
Figure 4:
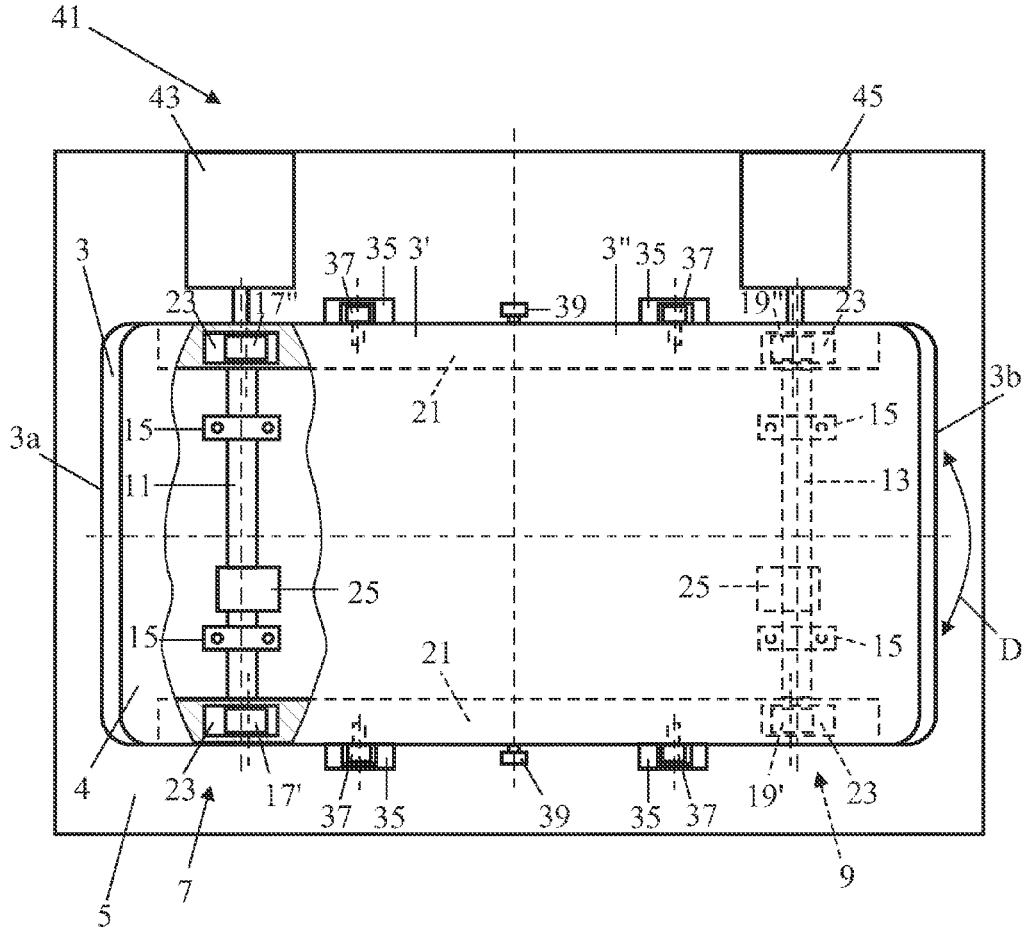
FIG. 4 is a top plan view of the apparatus shown in FIG. 3.

A second embodiment of the apparatus according to the invention is shown in FIGS. 3 and 4 in side elevation and from above respectively. All parts that are the same as those in the above first embodiment are indicated by the same reference figures. This apparatus 41 has two motors 43, 45, which can each drive a shaft 11, 13 independently of each other. This makes it possible to introduce more variations into how the footplate 3 can be made to vibrate. Moreover, in this embodiment there are no rubber blocks 40 between the footplate 3 and the plates 21; the footplate is directly fastened to the plates 21. Moreover, in this embodiment the guides 35 are present on the supporting plate 5 and the guiding elements 37 are connected to the footplate 3.

Although in the above the invention is explained on the basis of the drawings, it should be noted that the invention is in no way limited to the embodiments shown in the drawings. The invention also extends to all embodiments deviating from the embodiments shown in the drawings within the context defined by the claims.

Therefore, instead of the eccentric braces, the connecting elements can be formed by a circular slot provided with discs, in which the slot is eccentric with respect to the shaft, and in which the further connecting elements are formed by a sliding element or roller that can be moved in the slot.

Moreover, the oscillation devices can also be formed by an electrical coil with therein a moveable core, which is connected to the footplate, whereby the core can be forced into an oscillating movement by variation of the current through the coil.

Straps or a massage belt can also be fastened to the fastening lugs instead of or in supplement to the mat.

The guides shown here can also be replaced by flexible and/or elastic suspension elements, for example rubber blocks, which are fastened by an extremity to the supports on the bottom of the footplate and are fastened by the other extremity to the further supports on the top of the supporting plate. Preferably, the supports are present horizontally opposite to each other, so that a vertical movement of the supports with respect to each other is made more possible by the flexibility of the rubber blocks (elastic distortion/bending), and in which a horizontal movement of the supports with respect to each other is made possible by the elasticity of the blocks (press in and stretch).

The terminology used in the specification provided above is hereby defined to include similar and/or equivalent terms, and/or alternative embodiments that would be considered obvious to one skilled in the art given the teachings of the present patent application. Additionally, the words "a," "an," and "one" are defined to include one or more of the referenced item unless specifically stated otherwise. Also, the terms "have," "include," "contain," and similar terms are defined to mean "comprising" unless specifically stated otherwise.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A body-stimulating apparatus comprising:

a supporting plate;

a user occupied footplate above the supporting plate; two driven shafts; at least one motor for driving said driven shafts two oscillation devices driven by said driven shafts present at a distance from each other on the supporting plate and connected to the footplate for the oscillation of the footplate;

guiding devices via which the footplate is connected to the supporting plate, which guiding devices guide the footplate mainly in a vertical direction, wherein the guiding devices comprise at least one generally vertical guide fastened on the supporting plate, and at least one guiding element that is connected to the footplate and which works with the guide; and ball bearings fastened to the bottom of the footplate to support the footplate above the supporting plate, and which roll over the supporting plate during the oscillation of the footplate, so that a horizontal component of the oscillation of the footplate is allowed, and so that the movement that one of the oscillation devices makes is out of phase with and/or has another amplitude than the movement of the other oscillation devices, such that during the use of the footplate does not pivot around a horizontally fixed pivot axis with respect to the supporting plate.

* * * * *